US005647063A

United States Patent [19]

Bates

[11] Patent Number: 5,647,063

[45] Date of Patent: Jul. 15, 1997

[54] CARPENTER'S FINGER SPLINTER GUARD

[76] Inventor: Jeffrey S. Bates, 41 Trout Cir., Freeport, Fla. 32439

[21] Appl. No.: 610,927

[22] Filed: Mar. 5, 1996

[51] Int. Cl.[6] ..... A41D 13/00; A41D 13/08

[52] U.S. Cl. ..... 2/21; 223/101

[58] Field of Search ..... 2/21; 223/101; 602/22

[56] References Cited

U.S. PATENT DOCUMENTS

| | | | |
|---|---|---|---|
| D. 208,047 | 7/1967 | Brophy . | |
| 460,104 | 9/1891 | Barret . | |
| 471,221 | 3/1892 | Moores . | |
| 837,896 | 12/1906 | Bourne | 223/101 |
| 898,085 | 9/1908 | Blake | 223/101 |
| 1,160,522 | 11/1915 | Morris . | |
| 1,316,292 | 9/1919 | Fleming . | |
| 1,836,223 | 12/1931 | Burns et al. . | |
| 2,141,739 | 12/1938 | Burke . | |
| 2,225,571 | 12/1940 | Smith . | |
| 2,389,237 | 11/1945 | Petrullo . | |
| 2,434,317 | 1/1948 | Gross . | |
| 2,438,901 | 4/1948 | Coxe . | |
| 2,465,427 | 3/1949 | Bramberry | 2/21 |
| 2,709,419 | 5/1955 | Appel . | |
| 2,717,799 | 9/1955 | Jones | 2/21 |
| 2,935,354 | 5/1960 | Chapman | 2/21 |
| 3,178,724 | 4/1965 | Perschke . | |
| 3,293,958 | 12/1966 | Smith . | |
| 4,177,698 | 12/1979 | Greneker . | |
| 5,197,943 | 3/1993 | Link . | |

*Primary Examiner*—Bibhu Mohanty
*Attorney, Agent, or Firm*—David H. Semmes

[57] ABSTRACT

A finger guard which is made of impervious hardened plastic. It is open at the proximal end and tapered to closure adjacent the distal end. A compressible-extensible slot extends in axial alignment of the guard from the proximal end thereof to a position which is short of the absolute distal end. The guard slot, while closed during nonuse, is expandable into variant expandable widening positions, which positions are determined by the size of the carpenter's index finger. There are two factors which secure the splinter guard to the index finger. The first is by a resistance compression of the guard upon the finger, causing a friction fit. Secondly, as the asymmetric interior configuration of the guard conforms to the distal joint and fingernail extension of the finger, this causes a clamping effect and friction fit as the finger is forced into protected position. The guard is adaptable to either the left or right hand index finger without modification. Its utility extends to power sawing and board measurement.

1 Claim, 2 Drawing Sheets

CARPENTER'S FINGER SPLINTER GUARD

BACKGROUND OF THE INVENTION

The present finger splinter guard is adapted for use by carpenters when power sawing or measuring a board workpiece. The guard protects the index finger against splinters encountered during movement in either a strip cut or crosscut sawing. It is moreover very useful in measuring and pencil marking a board. The carpenter thus retains the rule by thumb and index finger, holding rule and marker in another, both hands and the rule being moved slideably along the board. The guard provides a skid against the board edge in strip measuring. In crosscut measuring a similar movement is necessary to protect the finger in marking.

Although made of a resilient armor-like substance, the guard is fully impermeable to splinters, its external and internal configurations relating closely to the external configuration of the carpenter's index finger. Due to an elongated, axially aligned slot in this tubular splinter guard, opening at the proximal end and terminating short of the distal end, the guard gap will expand or contract, depending upon the size of the index finger of the carpenter. This forced entry ensures its uniform fit to anyone's finger, regardless of its size.

As indicated, the utility of the finger guard extends not only to protection of the index finger from wood splinters along the side of a board during measuring and marking, but also during circular saw cutting of boards. In the latter instance, the circular saw rig is moved by one hand and operated by another hand. The function of the guard is to protect the finger from splinters of wood from edges of the board. Its utility in sawing extends to its usefulness when cutting with a circular saw which does or does not have its own board guide.

The best known prior art is represented by the following United States Letters Patent.

| INVENTOR | DATE | PAT. NO. | DESCRIPTION |
|---|---|---|---|
| Morris | 1915 | 1,160,522 | Finger Shield |
| Gross | 1948 | 2,434,317 | Finger Cot |
| Smith | 1966 | 3,293,958 | Finger-Mounted Tweezers |
| Brophy | 1967 | Des. 208,047 | Thimble |
| Greneker | 1979 | 4,177,698 | Finger Fit Implement |

In none of the prior art does one find an armored carpenter's finger guard which, due to its unique interior configuration, and elongated gap, fits in mating relationship with the index finger. The combination of guard elements ensures a friction fit to the user. Both exterior and interior profiles of the guard define three dimensional human characteristics of the finger.

SUMMARY OF INVENTION

The invention is defined as a finger guard which is made of a substantially impervious hardened plastic, opened at the proximal end and tapered to closure at distal end. A compressible-extensible gap extends in axial alignment from the proximal end of the guard to a position which is short of the absolute distal end. This guard gap is almost closed, but expandable into variant widening positions, dependent upon its forced expansion, which is determined by the size of the carpenter's index finger. There are two means by which the splinter guard of the invention secure to the index finger. The first is by a resistance compression of the guard upon the finger, causing a tapered friction fit. Secondly, by means of the asymmetric interior configuration of the guard, conforming to the distal joint and fingernail extension of the finger, there is caused a clamping effect as the finger is forced into protective position. The guard is adaptable to either a left or right hand index finger without modification.

The invention is illustrated in the following drawings wherein.

DESCRIPTION OF THE PREFERRED EMBODIMENTS

Figure 1:
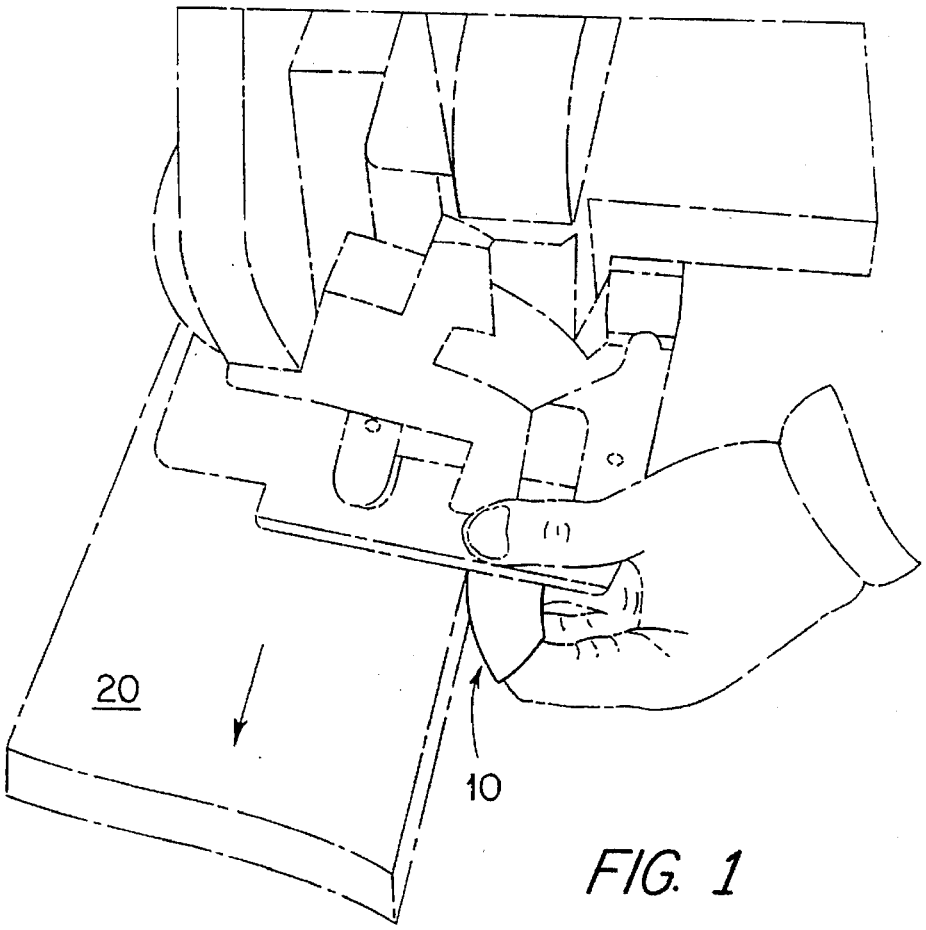
FIG. 1 illustrates utility of the invention in strip power sawing a board, with the grain, end to end.
Figure 2:
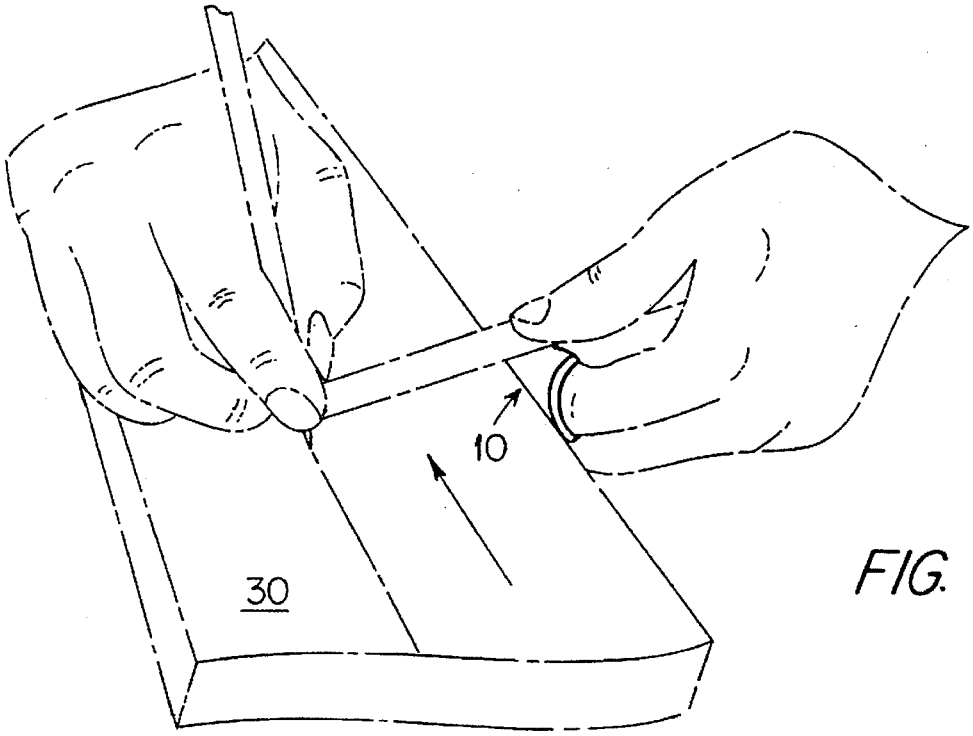
FIG. 2 illustrates utility of the invention during measuring a board for crosscut sawing.

As illustrated in FIGS. 1 and 2, the finger splinter guard 10 is especially useful to protect the index finger in power sawing when the index finger and thumb set a rotary blade saw at a preselected distance from the edge of a board 20 or 30. Although there is carpenter skill in steadying the power saw with or without its own adjustable guide, protection of the carpenter's index finger is most important. The splinter problem occurs either in strip or crosscut sawing. Sliding measurements from the edge or end of a board 20 likewise in lieu thereof presents a problem. See FIGS. 1 and 2.

Figure 3:
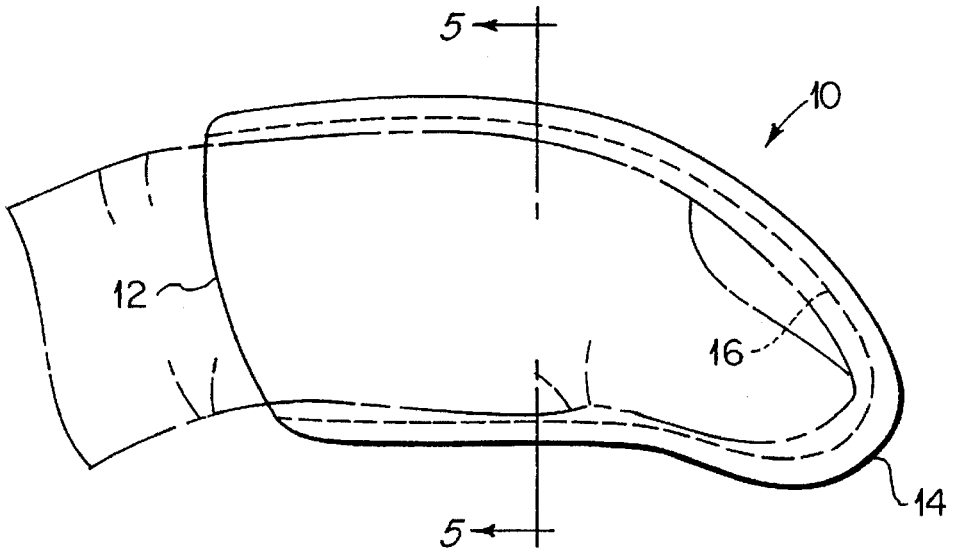
FIG. 3 is a side elevation view of the finger guard as applied to the finger of the carpenter.

The expansile-contractile finger guard 10, being made of a hard plastic composition, defines proximal end opening 12, its distal end 14 being closed. See FIG. 3. The distal end 14 forms an interior declination or slope 16, corresponding to the top slope of the index finger from the finger tip joint. This interior configuration corresponds to the finger exterior, up to and beyond the fingernail of the index finger of the carpenter.

Figure 4:
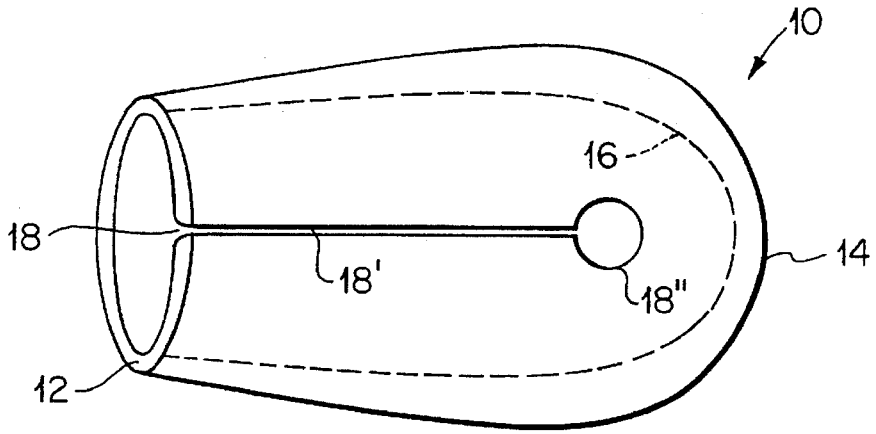
FIG. 4 is a bottom view of the invention illustrated in FIGS. 1, 2 and 3.
Figure 5:
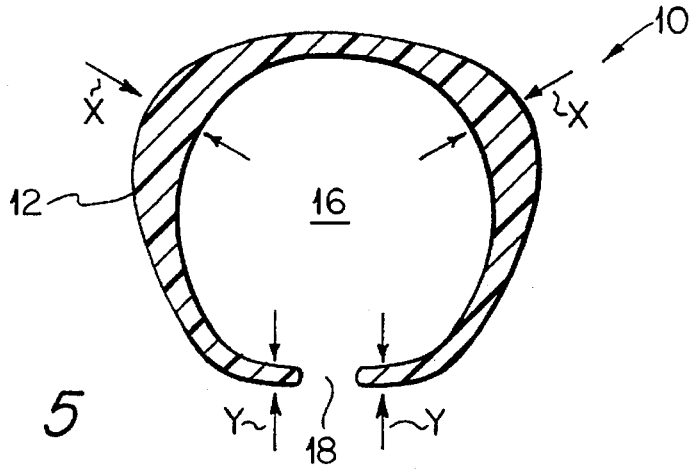
FIG. 5 is a view in vertical section of the finger guard taken along the line 5—5 of FIG. 3.

Referring to FIGS. 4 and 5 the compressible slot or gap 18 has elongated portion 18' commencing at the proximal end opening 12 of the guard. The slot 18 is essentially closed during nonuse except for a small circular opening 18" at its distal end. This opening keeps the slot from splitting as it expands to fit a larger finger. The difference in graduated thickness between the top and bottom of the guard at FIG. 5 permits the guard to be flexible enough to expand. The closed end orifice 18" terminates short of the end of interior slope 16. Whereas it is significant that the interior 16 of the splinter guard conforms to the external anatomy of the human finger, likewise the open proximal end 12 of the guard conforms in declination to the exposed joint of the finger when slightly flexed downward; see FIG. 3. A reverse angle is thus defined by end 12, relative to a line drawn through the vertical cross-section of the guard. See line 5—5. Flexure of the finger when holding saw or rule is thus not impeded. From the vertical, a typical angle given to the boundaries of the opening 12 would range between 315° to less than 360° .

Referring to FIG. 5, the vertical section line 5—5 presents the relative graduated thicknesses of 1/16" at laterally opposed bottom in lieu thereof segments at laterally "Y", to 3/16" opposed top segments in lieu thereof "X" of the guard 10. The delineated cross-sectional area marked "X" is the spot on which the guard rubs against the edge of the board, while the guard is in use by either a lefthand or righthand carpenter.

Whereas the invention has been defined with respect to its adaptability to the human index finger during either strip or crosscut power sawing and associated board measurements, the scope of invention is to be determined by reference to the ensuing claims, wherein:

I claim:

1. A compressibly resilient carpenter's finger guard which is friction fitted upon the extension of a carpenter's finger between the intermediate joint thereof and the fingertip comprising:

a) an elongated tubular finger guard (10) of armor-like substance which is declinedly open at its proximal end (12) and tapered to closure at its distal end (14), the proximal end (12) being immediately adjacent the intermediate finger joint, conforming in side elevation to the crease of the finger when flexed at its intermediate joint; said open proximal end (12) of the guard (10) thus defining a reverse angle from the vertical, which is between 315° to less than 360° .

b) the interior (16) of the guard, adjacent the distal end (14) conforming in cross-section to the tapered configuration of the finger, between its intermediate joint and the fingertip;

c) a lowermost expandable-compressible slot (18) extending from the proximal end (18') of the guard to closure at its distal end, the slot closure defining a circular opening (18") which is spaced from the distal end of the guard;

d) laterally opposed segments of the guard which are transversely adjacent its top, being of graduated maximum thickness X in vertical cross-section, and laterally opposed segments which are at its bottom being of minimum thickness Y.

* * * * *